US005666915A

United States Patent [19]

Kawashima et al.

[11] Patent Number: 5,666,915

[45] Date of Patent: Sep. 16, 1997

[54] OIL PASSAGE STRUCTURE IN AN ENGINE

[75] Inventors: Fuminori Kawashima; Hideo Ueshima; Keiji Ohtsu; Yoshihito Tsuji; Masayuki Takahashi, all of Wako, Japan

[73] Assignee: Honda Giken Kogyo Kabushiki Kaisha, Tokyo, Japan

[21] Appl. No.: 563,387

[22] Filed: Nov. 28, 1995

[30] Foreign Application Priority Data

Nov. 30, 1994 [JP] Japan ..... 6-296948
Oct. 23, 1995 [JP] Japan ..... 7-274109

[51] Int. Cl.[6] ..... F01L 9/02

[52] U.S. Cl. ..... 123/196 R; 123/90.12

[58] Field of Search ..... 123/196 R, 90.12, 123/90.13, 90.33

[56] References Cited

U.S. PATENT DOCUMENTS

| | | | |
|---|---|---|---|
| 4,883,027 | 11/1989 | Oikawa et al. | 123/90.33 |
| 5,003,937 | 4/1991 | Matsumoto et al. | 123/90.12 |
| 5,271,360 | 12/1993 | Kano et al. | 123/90.33 |
| 5,497,736 | 3/1996 | Miller et al. | 1123/90.13 |

FOREIGN PATENT DOCUMENTS 5-71315 3/1993 Japan .

*Primary Examiner*—Erick R. Solis
*Attorney, Agent, or Firm*—Nikaido Marmelstein Murray & Oram LLP

[57] ABSTRACT

An oil passage structure in an engine includes a first oil passage and a second oil passage. The second oil passage has a hydraulic pressure which is different from that in the first oil passage. The first and second oil passages are provided in engine body in an arrangement where they intersect each other when viewed in projection onto a plane parallel to an axis of the first oil passage. In order to enable the space for disposition of both the oil passages to be reduced to a necessary minimum to provide a reduction in size of the engine body, a cylindrical partition member having annular seal members mounted on its outer surface at opposite ends is fitted into the first oil passage. Thus, an annular intermediate chamber is defined between the outer surface of the partition member and an inner surface of the first oil passage and is sealed at its opposite ends by the seal members. The second oil passage is provided in the engine body in an arrangement where upstream and downstream passage portion thereof communicate with each other through the intermediate chamber.

5 Claims, 14 Drawing Sheets

OIL PASSAGE STRUCTURE IN AN ENGINE

BACKGROUND OF THE INVENTION

1. Field of the Invention

The present invention relates to an oil passage structure in an engine, including a first oil passage and a second oil passage. The second oil passages has oil having a hydraulic pressure which is different from the hydraulic pressure of the oil in the first oil passage. The first and second oil passages are provided in an engine body in an arrangement where they intersect each other when viewed in projection onto a plane parallel to an axis of the first oil passage.

2. Description of the Prior Art

In a conventional oil passage structure, it is common that the first and second oil passages are provided in the engine body at locations spaced apart from each other, as disclosed in Japanese Patent Application Laid-Open No. 71315/93.

If the oil passages are provided in the engine body at spaced-apart locations as in the prior art, the engine body becomes large, in size in order to insure sufficient space for separating the oil passages apart from each other.

SUMMARY OF THE INVENTION

Accordingly, it is an object of the present invention to provide an oil passage structure in an engine, wherein a space for disposition of both the oil passages can be reduced to a minimum, thereby reducing the size of the engine body.

To achieve the above object, according to a first aspect and feature of the present invention, there is provided an oil passage structure in an engine, comprising a first oil passage having a first hydraulic pressure and a second oil passage having a second hydraulic pressure which is different from that of the first oil passage. The first and second oil passages are provided in an engine body in an arrangement where they intersect each other when viewed in projection onto a plane parallel to an axis of the first oil passage. The structure further includes a cylindrical partition member which is fitted into the first oil passage and which is provided at outer surfaces of opposite ends thereof with annular seal members. An annular intermediate chamber is defined between the outer surface of the partition member and an inner surface of the first oil passage and is sealed at opposite ends of the intermediate chamber by the seal members. The second oil passage is provided in the engine body such that upstream and downstream passage portions of the second oil passage communicate with each other through the intermediate chamber.

It is another object of the present invention to facilitate the drilling of the oil passages in such a manner that both the positions of the downstream passage portions can be easily offset along an axis of a crankshaft, to avoid an increase in size of the engine body, and to insure a sufficient flow area of a blow-by gas passage or an oil return passage provided in a thick portion.

To achieve the above object, according to a second aspect and feature of the present invention, in addition to the first feature, the engine body is constructed into a V-shaped configuration having left and right banks whose cylinder bores are off set from each other in an axial direction of a crankshaft. A thick portion is formed in one of the banks at one end of the engine body in the axial direction of the crankshaft as a result of offsetting of the cylinder bores. The first oil passage is provided in the engine body at a substantially central portion between both the banks in parallel to the crankshaft. The second oil passage comprises an upstream passage portion and first and second downstream passage portions. The upstream passage portion leads to the intermediate chamber. The first downstream passage portion is provided in the engine body in one of the banks and leads to the intermediate chamber and is separated from a blow-by gas passage or an oil return passage which is provided in the thick portion. The second downstream passage portion communicates with the intermediate chamber and is provided in the engine body in the other bank. The first and second downstream passage portions are disposed in the engine body such as to be offset in the same direction as a direction of offsetting of the cylinder bores in the banks.

It is a further object of the present invention to enable an axial shortening of the partition member to further effectively achieve a reduction in size of the engine body.

To achieve the above object, according to a third aspect and feature of the present invention, in addition to the first feature, the engine body is constructed into a V-shaped configuration having left and right banks. The first oil passage is provided in the engine body at a substantially central portion between both the banks in parallel to a crankshaft. The second oil passage comprising an upstream passage portion and first and second downstream passage portions. The upstream passage portion leads to the intermediate chamber. The first downstream passage portion is provided in the engine body in one of the banks and leads to the intermediate chamber. The second downstream passage portion is provided in the engine body in the other bank and communicates with the intermediate chamber. The first and second downstream passage portions are disposed in the engine body substantially at the same position along the axial direction of the crankshaft.

Further, it is another object of the present invention to further facilitate the drilling of the oil passages.

To achieve the above object, according to a fourth aspect and feature of the present invention, in addition to the second or third features, the upstream passage portion and one of the first and second downstream passage portions of the second oil passage are defined axially and in one straight line.

The above and other objects, features and advantages of the invention will become apparent from the following description of preferred embodiments taken in conjunction with the accompanying drawings.

DESCRIPTION OF THE PREFERRED EMBODIMENTS

The present invention will be now be described by way of preferred embodiments with reference to the accompanying drawings.

Figure 1:
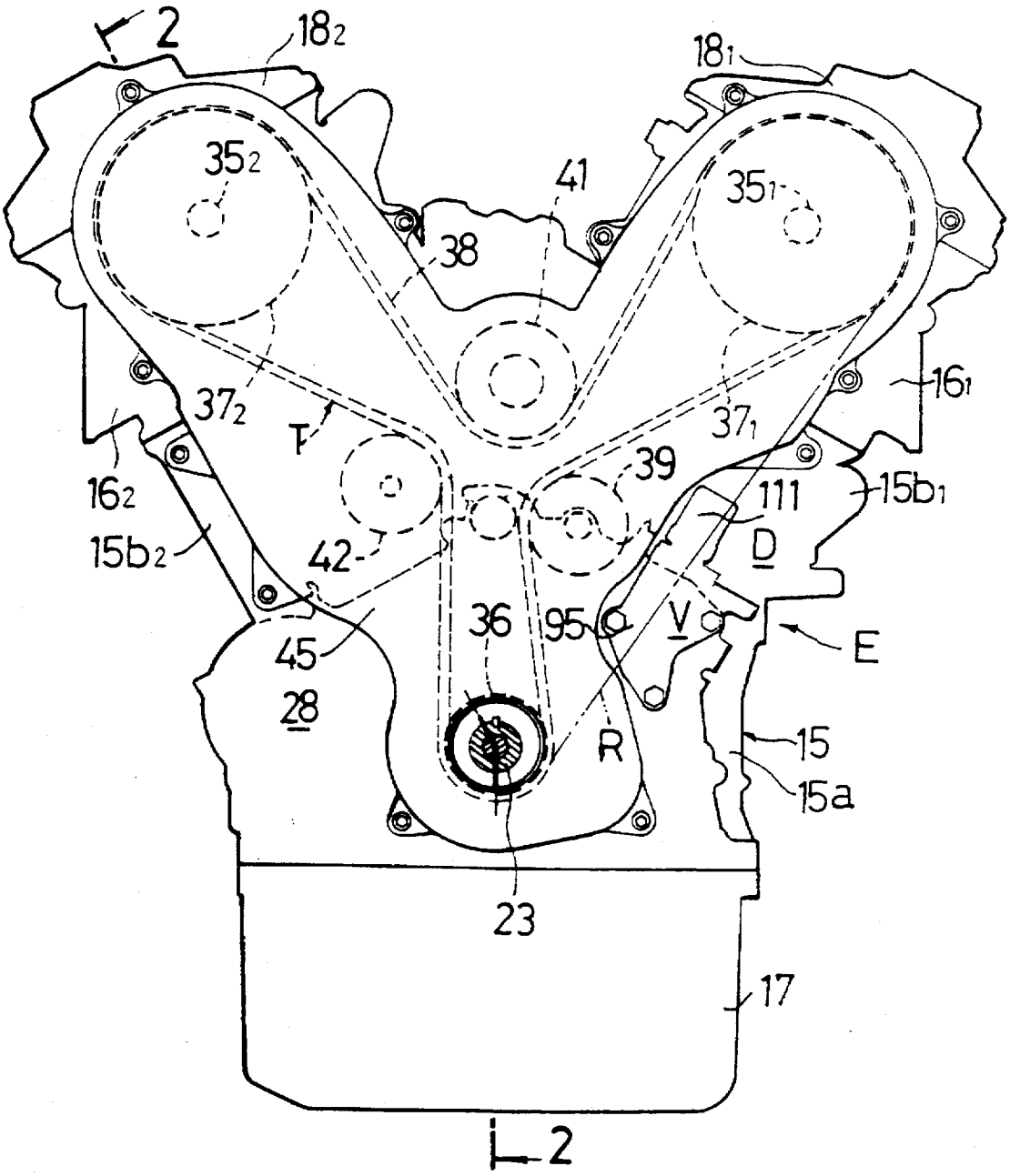
FIG. 1 is a front view of a V-shaped engine to which a first embodiment of the present invention is applied.
Figure 2:
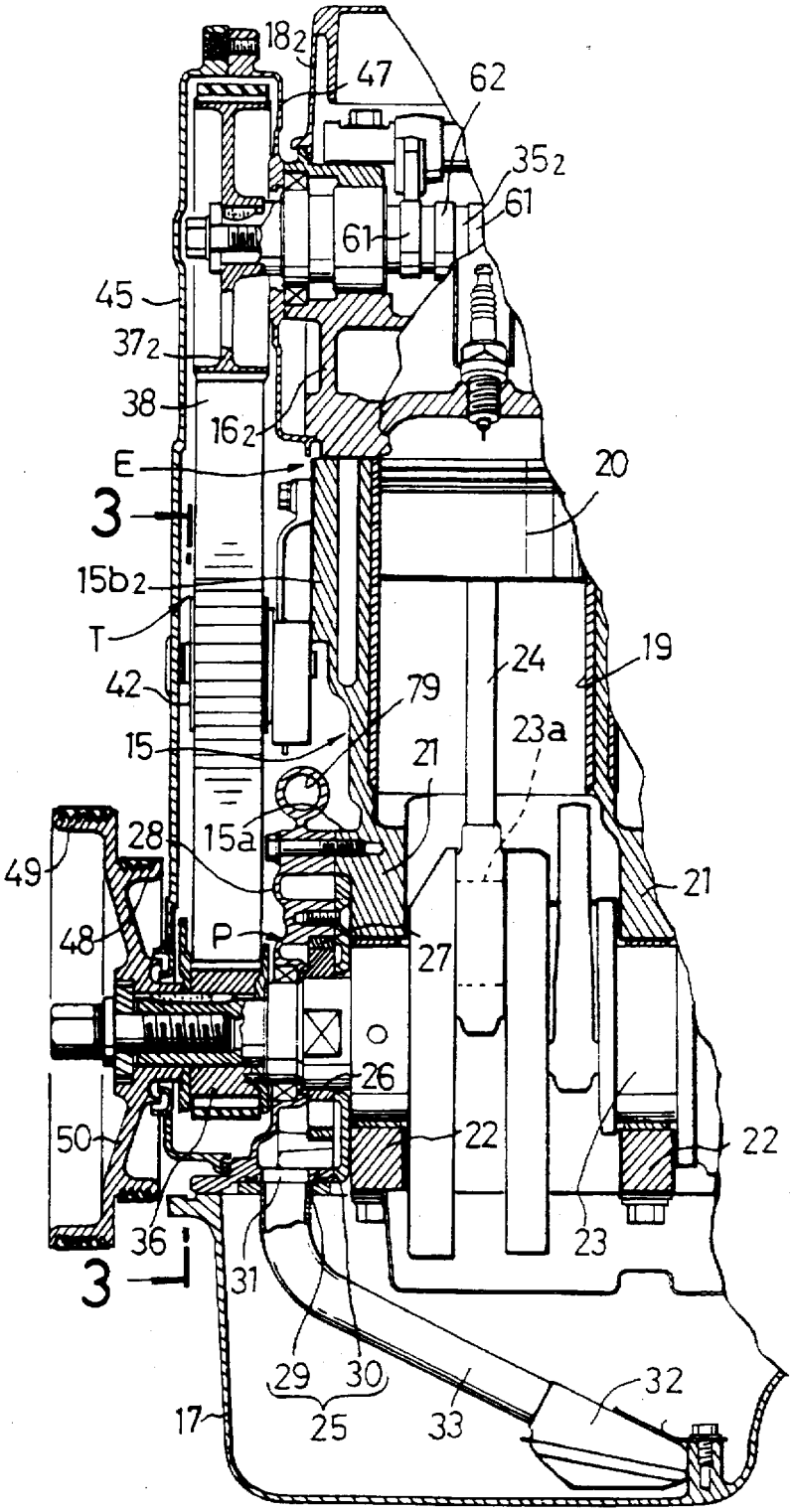
FIG. 2 is an enlarged sectional view taken along a line 2—2 in FIG. 1.

Referring first to FIGS. 1 and 2, an engine body E includes a pair of cylinder head $16_1$ and $16_2$ coupled to an upper portion of a cylinder block 15 which is formed into a V-shape. An oil pan 17 is coupled to a lower portion of the cylinder block 15, and head covers $18_1$ and $18_2$ are coupled to upper portions of the cylinder heads $16_1$ and $16_2$, respectively.

The cylinder block 15 includes a crankcase portion 15*a*, and a pair of cylinder barrels $15b_1$ and $15b_2$ extending upwardly from the crankcase portion 15*a* so as to form a V-shape. The cylinder heads $16_1$ and $16_2$ are coupled to upper portions of the cylinder barrels $15b_1$ and $15b_2$. A plurality of cylinder bores 19 are provided and arranged in series in the cylinder barrels $15b_1$ and $15b_2$, and pistons 20 are slidably received in the cylinder bores 19, respectively. A plurality of journal bearings 21 are provided on the crankcase portion 15*a* at distances in a direction of arrangement of the cylinder bores 19. A crankshaft 23 is rotatably supported by bearing caps 22 secured to lower surfaces of the journal bearings 21 and by the journal bearings 21, and crank pins 23*a* of the crankshaft 23 and the pistons 20 are interconnected through connecting rods 24.

An oil pump P is disposed on an outer surface of a sidewall of the cylinder block 15 adjacent axially one end of the crankshaft 23 and driven by the crankshaft 23. The oil pump P is a trochoidal pump which includes an inner rotor 26 fixed to the crankshaft 23 and an outer rotor 27 meshed with the inner rotor 26, such that the rotors 26 and 27 are rotatably accommodated and arranged in eccentric positions within a pump case 25 which is mounted to the outer surface of the sidewall of the cylinder block 15.

Figure 3:
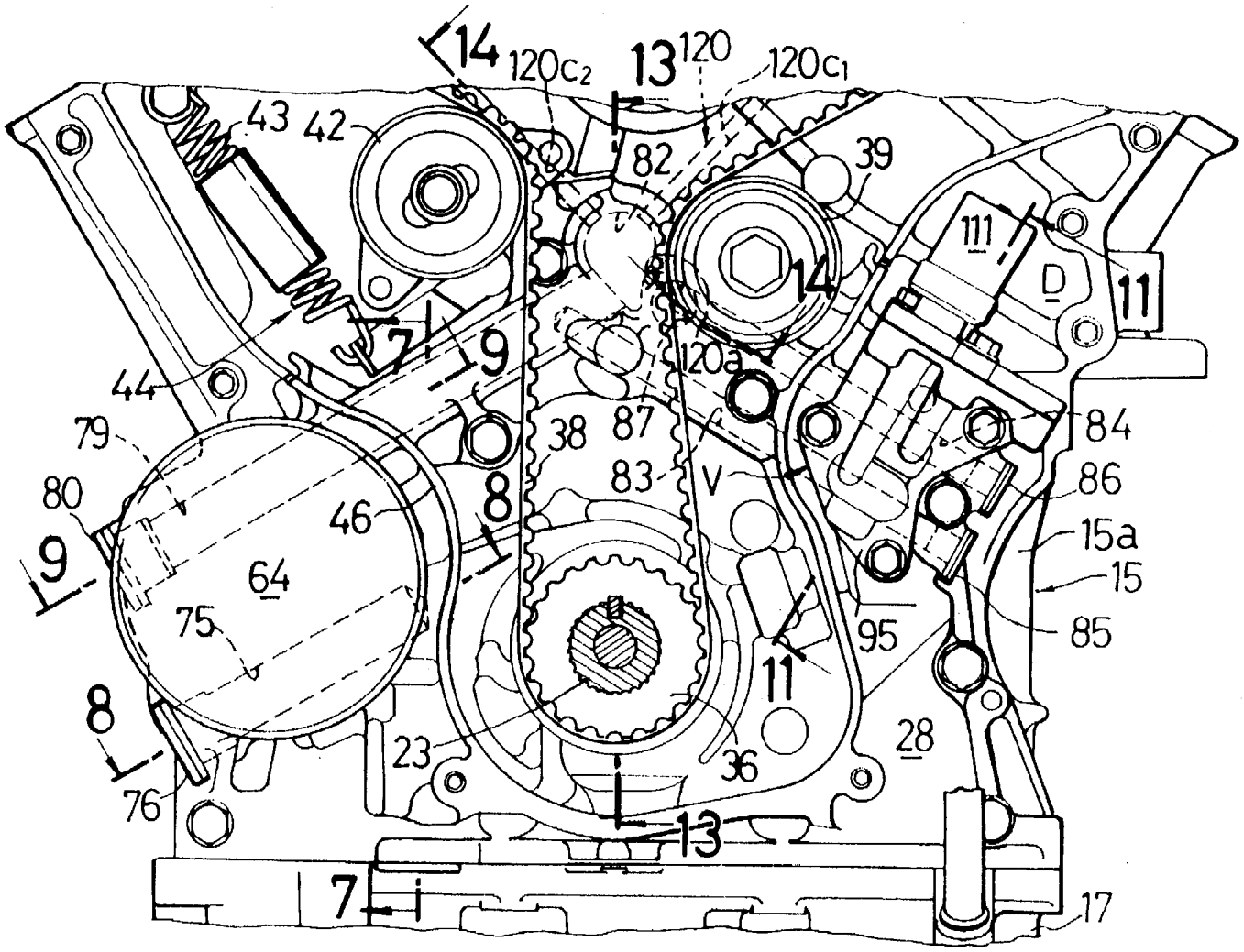
FIG. 3 is a sectional view taken along a line 3—3 in FIG. 2 with a cover removed.
Figure 4:
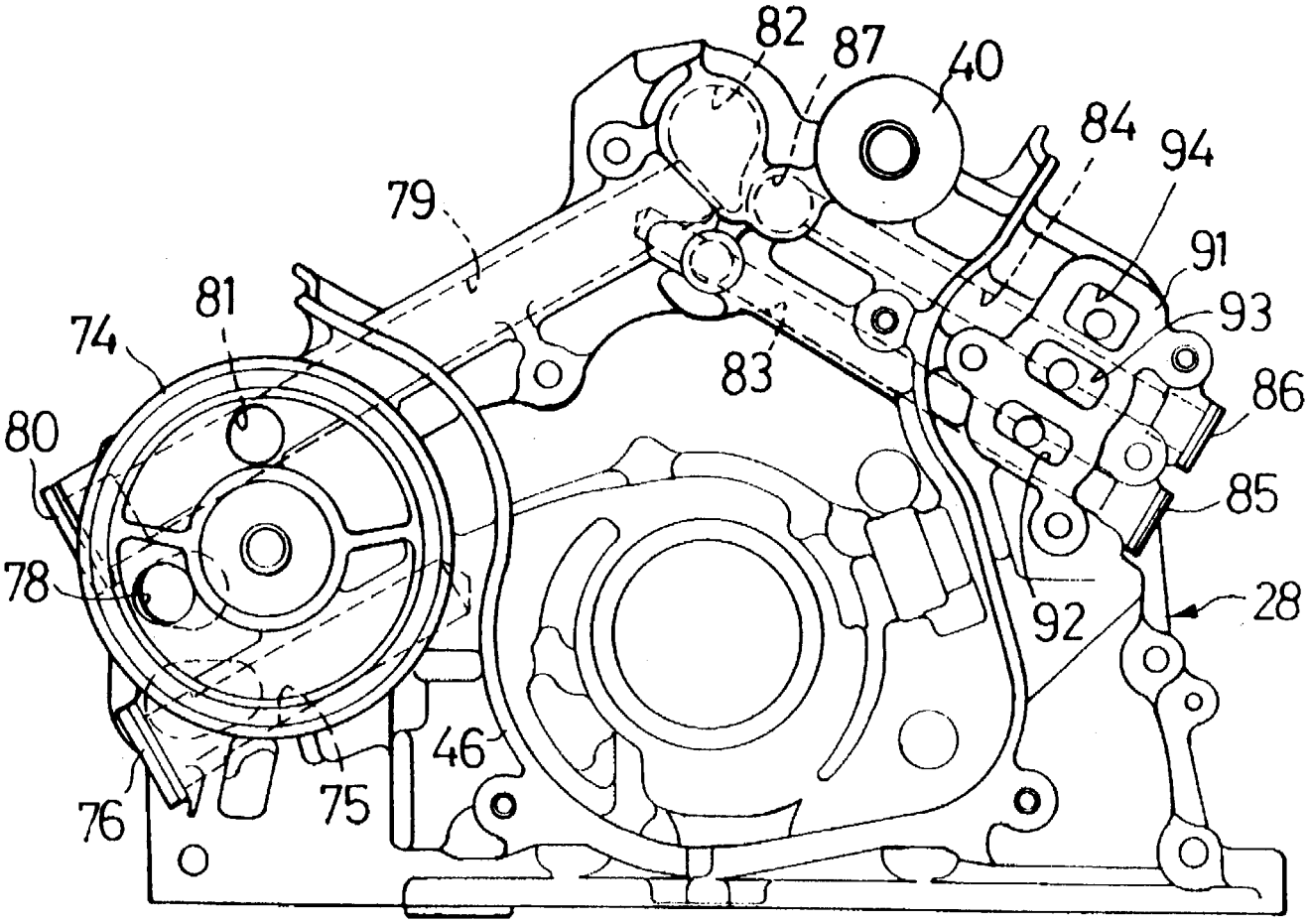
FIG. 4 is a front view of a pump body.
Figure 5:
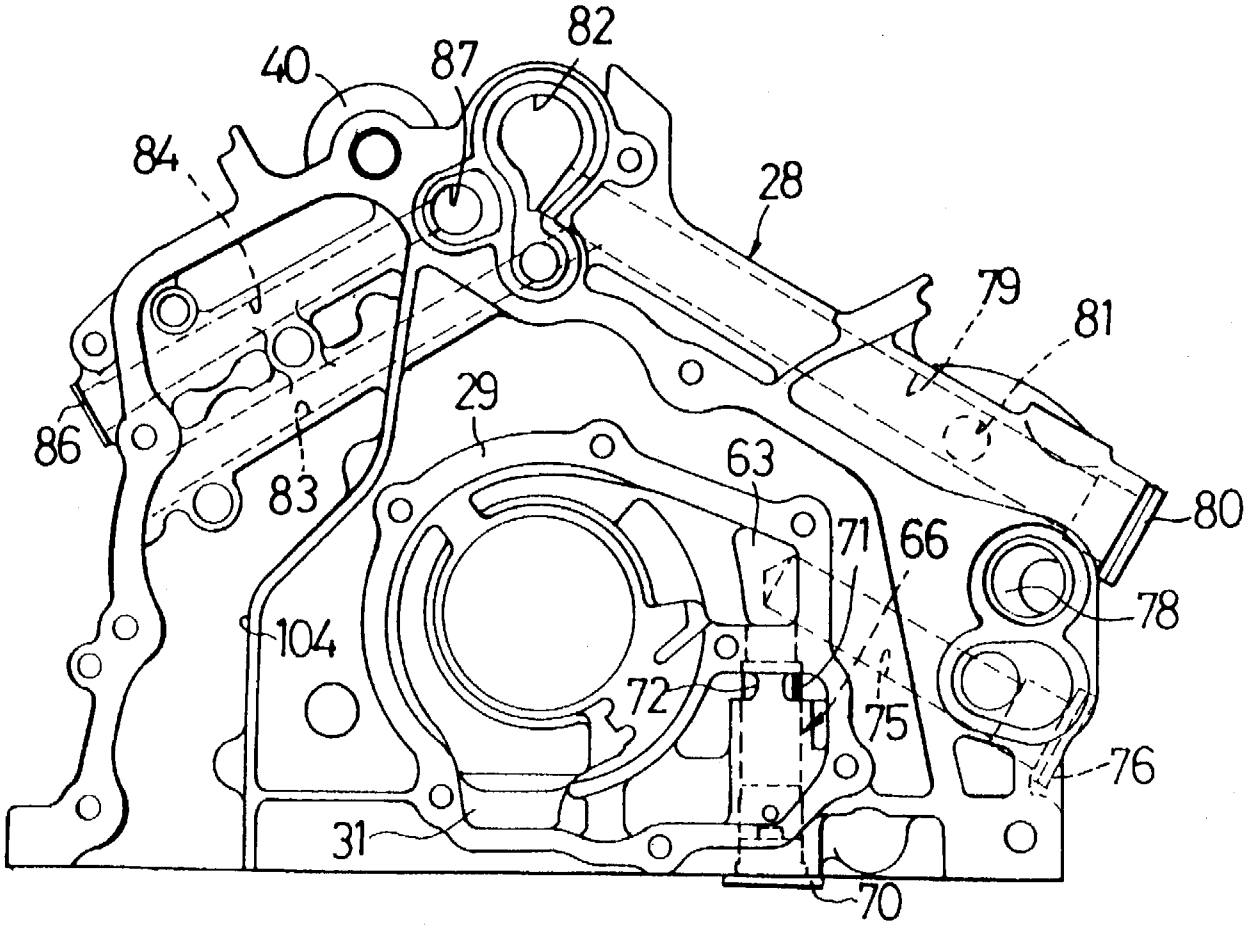
FIG. 5 is a back view of the pump body.

Referring also to FIGS. 3, 4 and 5, a pump body 28 is fastened to an outer surface of the sidewall of the cylinder block 15. The pump case 25 includes a pump case portion 29 provided on the side of a back of the pump body 28, and a case member 30 coupled to the pump case portion 29. In a condition in which the case member 30 has been mounted on the side of the back of the pump case portion 29, i.e., on the side of the cylinder block 15, the pump body 28 is coupled to the cylinder block 15.

An oil strainer 32 is disposed within the oil pan 17 and connected to an suction port 31 provided in the pump case 25 through a suction pipe 33.

A wrapping connector driving system T is disposed at a location in proximity to an outer surface of one sidewall of the engine body E for driving valve operating cam shafts $35_1$ and $35_2$ which are rotatably carried in the cylinder head $16_1$ and $16_2$ in parallel to the crankshaft 23, respectively. The wrapping connector driving system T includes a first driving pulley 36 fixed to an end of the crankshaft 23 projecting from the pump case 25 of the oil pump P, follower pulleys $37_1$ and $37_2$ fixed to ends of the valve operating cam shafts $35_1$ and $35_2$, respectively, and an endless timing belt 38 wound around the first driving pulley 36 and the follower pulleys $37_1$ and $37_2$. The first driving pulley 36 is fixed to the crankshaft 23 at a location where the pump case 25 is sandwiched between the first driving pulley 36 itself and the outer surface of the sidewall of the cylinder block 15.

In the wrapping connector driving system T, an idle pulley 39 is engaged with an outer periphery of the timing belt 38 between the first driving pulley 36 and the follower pulley $37_1$, so that the traveling path of the timing belt 38 is offset inwardly from a phantom path R (see FIG. 1) provided if the first driving pulley 36 and the follower pulley $37_1$ are interconnected directly in a straight line, i.e., offset in a direction to increase the amount the timing belt 38 is wound around the first driving pulley 36 and the follower pulley $37_1$. A boss 40 for rotatably supporting the idle pulley 39 is mounted on the pump body 28.

The timing belt 38 is wound around a water pump 41 which is located between both the follower pulleys $37_1$ and $37_2$. A rotary wheel 42 is engaged around an outer periphery of the timing belt 38 between the follower pulley $37_2$ and the first driving pulley 36. A tensioner 44 is constituted by the first driving pulley 36 together with a tension spring 43, which exhibits a spring force. The tensioner 44 brings the rotary wheel 42 into pressure contact with the timing belt 38.

The wrapping connector driving system T is covered with a cover 45. A ridge portion 46, for engagement of a peripheral edge of the cover 45 at its lower portion, is provided on the pump body 28 to surround the idle pulley 39. A rear cover 47 is disposed between the cylinder heads $16_1$ and $16_2$ and coupled to an upper portion of the cover 45.

The crankshaft 23 protrudes from the cover 45. A rotary wheel 50 is secured to this protruding end of the crankshaft 23 from the cover 45, and has a second driving pulley 48 for driving, for example, an AC generator or a compressor for an air conditioner (both not shown), and a third driving pulley 49 for driving, for example, a power-steering hydraulic pump (not shown).

Figure 6:
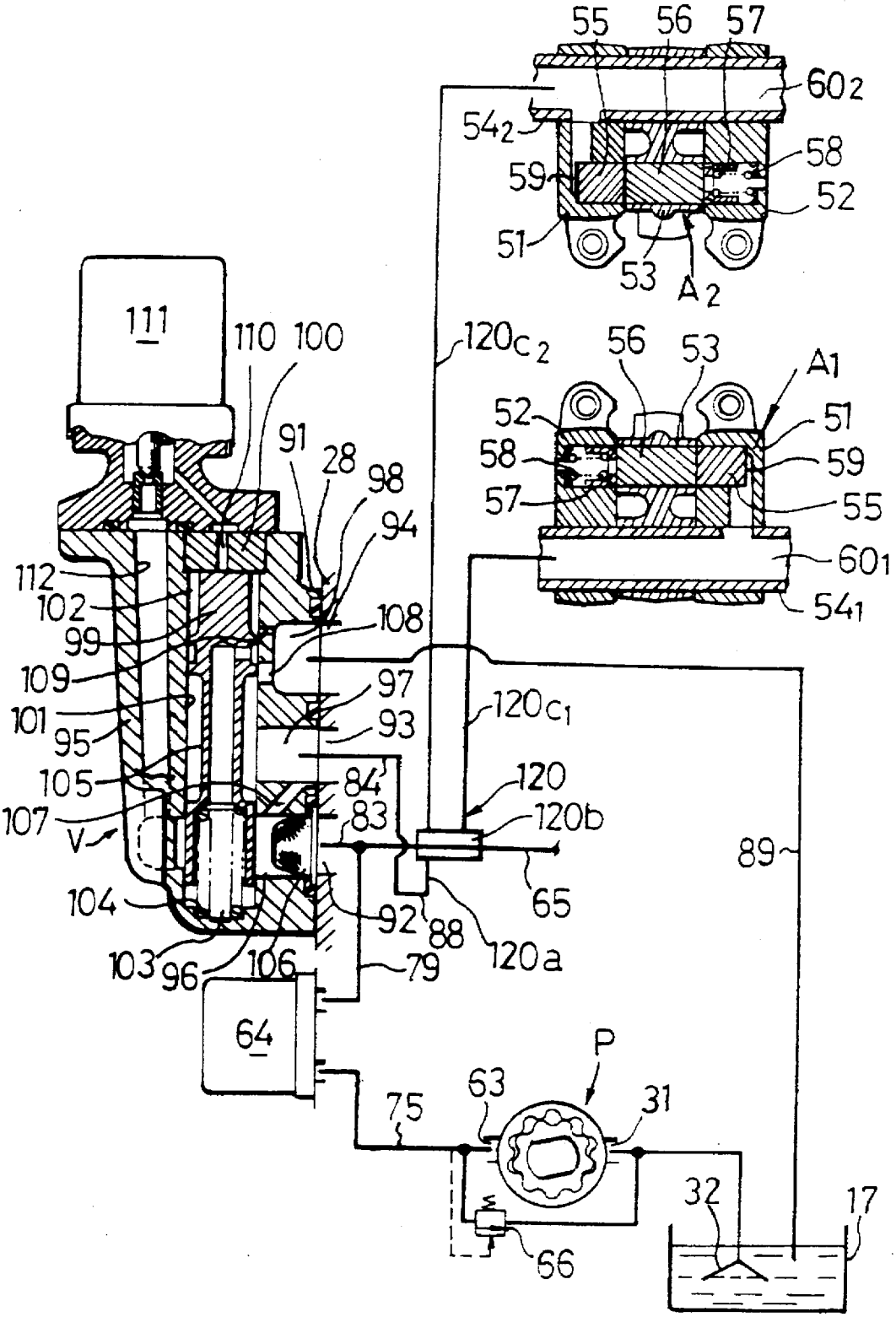
FIG. 6 is an illustration of a hydraulic circuit.

Referring to FIG. 6, the engine includes a pair of intake valves (not shown) for every cylinder bore 19 in each of the cylinder barrels $15b_1$ and $15b_2$. Each of the intake valves for every cylinder bore 19 in one of the cylinder barrels $15b_1$ is changeable in operating characteristic by a hydraulic actuator $A_1$, and each of the intake valves for every cylinder bore 19 in the other cylinder barrel $15b_2$ is changeable in operating characteristic by a hydraulic actuator $A_2$.

In the cylinder barrel $15b_2$, both the intake valves are operatively connected to a pair of driving rocker arms 51 and 52, respectively. The driving rocker arms 51 and 52 and a free rocker arm 53, sandwiched between the driving rocker arms 51 and 52, are swingably carried on a stationary rocker shaft $54_2$. The driving rocker arms 51 and 52 are swung by a pair of low-speed cams 61, 61 (see FIG. 2) provided on the valve operating cam shaft $35_2$ and the free rocker arm 53 is swung by a high-speed cam 62 (see FIG. 2) provided on the valve operating cam shaft $35_2$.

The hydraulic actuator $A_2$ includes a first switchover pin 55 which is slidably received in the driving rocker arm 51 and capable of being fitted into the free rocker arm 53. A hydraulic pressure chamber 59 is defined between the first switchover pin 55 and the driving rocker arm 51. A second switchover pin 56 is slidably received in the free rocker arm 53 with its one end face abutting against an end face of the first switchover pin 55 opposite from the hydraulic pressure chamber 59. The second switching pin 56 is capable of being fitted into the other driving rocker arm 52. A limiting pin 57 is slidably received in the other driving rocker arm 52 to abut against the other end face of the second switchover pin 56. A return spring 58 is mounted under compression between the driving rocker arm 52 and the limiting pin 57 to exhibit a spring force for biasing the limiting pin 57 in abutment against the first switchover pin 55 through the second switchover pin 56 toward the hydraulic pressure chamber 59. Moreover, an oil passage $60_2$ is provided in the rocker shaft $54_2$ to perpendicularly communicate with the hydraulic pressure chamber 59.

In such a hydraulic actuator $A_2$, if the hydraulic pressure in the hydraulic pressure chamber 59 is increased, the first switchover pin 55 is fitted into the free rocker arm 53 and at the same time, the second switchover pin 56 is fitted into the driving rocker arm 52, thereby connecting the rocker arms 51, 52 and 53 to one another. When the rocker arms 51, 52 and 53 have been connected in this manner, the driving rocker arms 51 and 52 are swung in unison with the free rocker arm 53 which is swung by the high-speed cam 62, thereby causing the intake valves to be opened and closed with a timing and a lift amount dependent upon the high-speed cam 62. If the hydraulic pressure in the hydraulic pressure chamber 59 is reduced, the first switchover pin 55 is returned by the spring force of the return spring 58 to a position in which its surface, which is in abutment against the second switchover pin 56, corresponds to a boundary between the driving rocker arm 51 and the free rocker arm 53. The second switchover pin 56 is returned to a position in which its surface, which is in abutment against the limiting pin 57, corresponds to a boundary between the free rocker arm 53 and the driving rocker arm 52, thereby releasing the connection of the rocker arms 51, 52 and 53. In this disconnected condition, the driving rocker arms 51 and 52 are swung by the low-speed cams 61, 61, thereby causing the intake valves to be opened and closed with a timing and a lift amount dependent upon the low-speed cams 61, 61.

In the cylinder barrel $15b_1$, both the intake valves are operatively connected to a pair of driving rocker arms 51 and 52 swung by low-speed cams (not shown), respectively. The driving rocker arms 51 and 52 and a free rocker arm 53 are swingably carried on a stationary rocker shaft $54_1$. The free rocker arm 53 is sandwiched between the driving rocker arms 51 and 52 and swung by a high-speed cam (not shown). The hydraulic actuator $A_1$ mounted in these rocker arms 51, 52 and 53 is constructed in the same manner as the above-described hydraulic actuator $A_2$, and an oil passage $60_1$ is provided in the rocker shaft $54_1$.

The oil pump P has a discharge port 63 which is connected to a main gallery 65 through a filter/cooler unit 64 and also connected to oil passages $60_1$ and $60_2$ in the rocker shafts $54_1$ and $54_2$ through a filter/cooler unit 64 and a hydraulic pressure control valve V. A relief valve 66 is provided between the suction port 31 and the discharge port 63 in the oil pump P.

Figure 7:
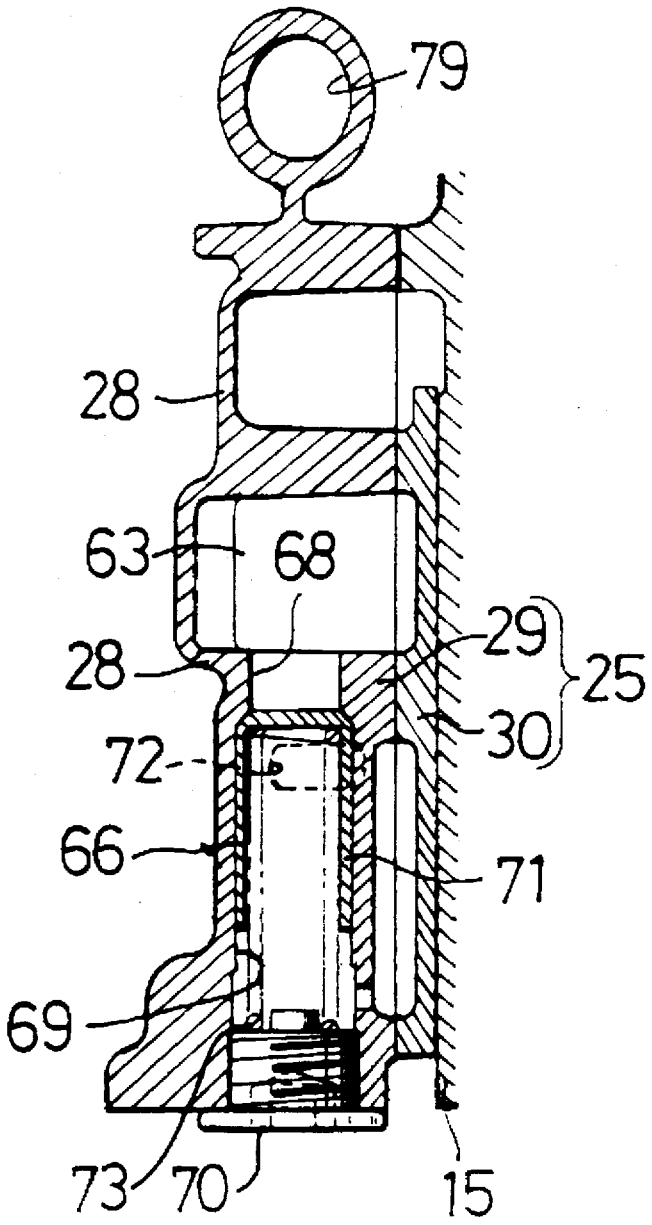
FIG. 7 is a sectional view taken along a line 7—7 in FIG. 3.

Referring to FIG. 7, the relief valve 66 is disposed at the pump case portion 29 of the pump body 29, and includes a bottomed cylindrical valve member 71 slidably received in a large-diameter bore 69. The large-diameter bore 69 is coaxially connected through a stepped portion to the a small-diameter bore 68 which leads to the discharge port 63. The large-diameter bore 69 is closed at its outer end by a cap 70. A valve spring 73 is mounted under compression between the valve body 71 and the cap 70 and exhibits a spring force in a direction to close a communication bore 72 which leads to the suction port 31 and which opens into the large-diameter bore 69. If a force provided in a valve opening direction by a hydraulic pressure in the discharge port 63 acting on the valve member 71 becomes larger than a force provided in a valve closing direction by the valve spring 73, the valve member 71 is moved to a position in which it permits the communication bore 72 connected to the suction port 31 to be put into communication with the small-diameter bore 68, thereby causing a portion of oil to be returned from the discharge port 63 to the suction port 31.

A circular mounting seat 74 is provided on an outer surface of the pump body 28 at a location adjacent the oil pump P, and the filter/cooler unit 64 is mounted on the mounting seat 74.

Figure 8:
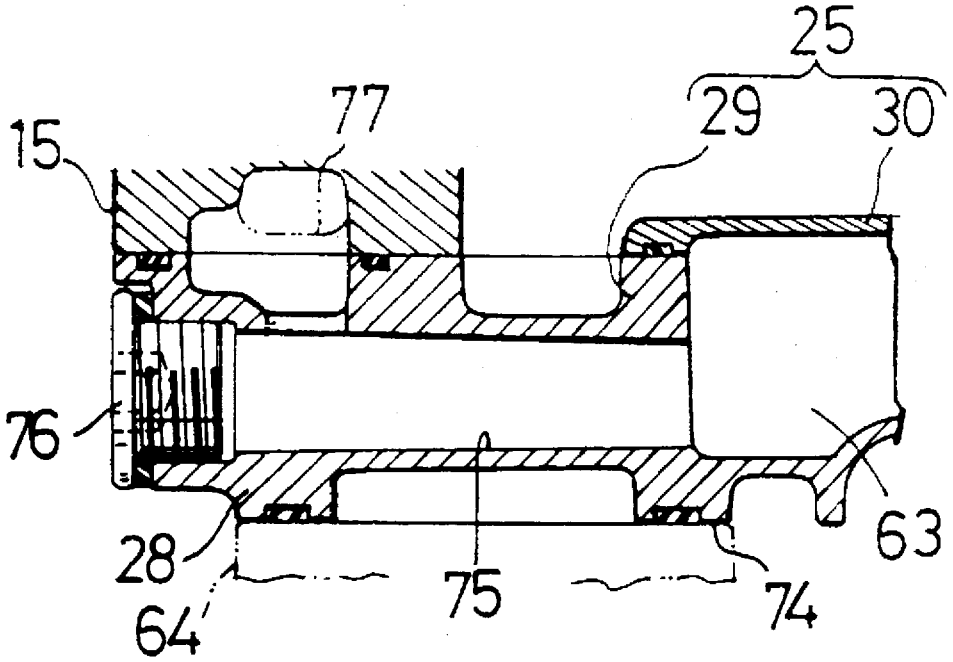
FIG. 8 is a sectional view taken along a line 8—8 in FIG. 3.

As shown in FIG. 8, an oil passage 75 is provided in the pump body 28 to extend rectilinearly at a location corresponding to the mounting seat 74. The oil passage 75 has an inner end leading to the discharge port 63 of the oil pump P, and an outer end is closed by a cap 76. An inlet bore 78 (see FIG. 14) is also provided in the pump body 28 and opens into the mounting seat 74. A communication passage 77 is provided in the cylinder block 15. In a condition in which the pump body 28 has been coupled to the cylinder block 15, one end of the communication passage 77 is in communication with the oil passage 75 in proximity to the cap 76, and the other end of the communication passage 77 is in communication with the inlet bore 78.

Figure 9:
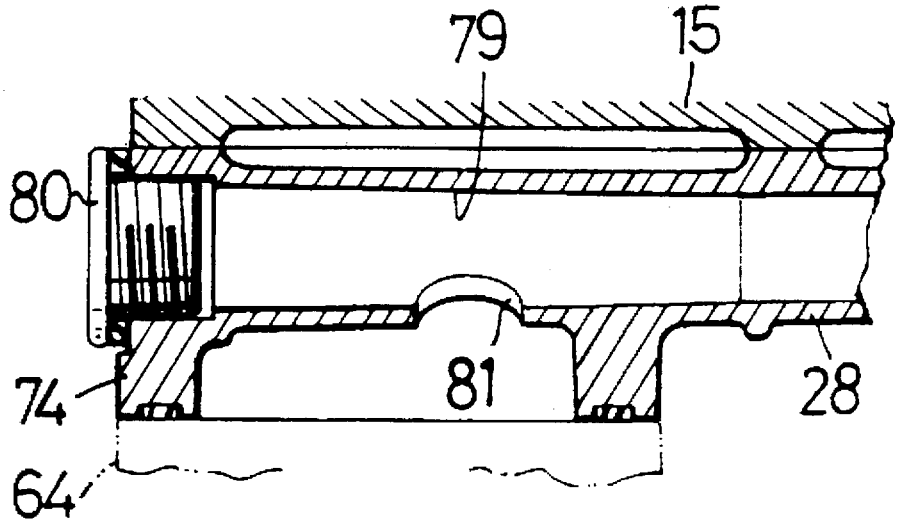
FIG. 9 is a sectional view taken along a line 9—9 in FIG. 3.

As shown in FIG. 9, an oil passage 79 is provided in the pump body 28 substantially in parallel to the oil passage 75 at a location corresponding to the mounting seat 74, and is closed by a cap 80. An outlet bore 81 is provided in the pump body 28 to open into the mounting seat 74 and to communicate with the oil passage 79.

Thus, the oil discharged from the oil pump P is introduced through the oil passage 75 via the communication passage 77 and the inlet bore 78 into the filter/cooler unit 64. The oil which was cooled while being purified in the filter/cooler unit 64 is discharged through the outlet bore 81 into the oil passage 79.

Figure 10:
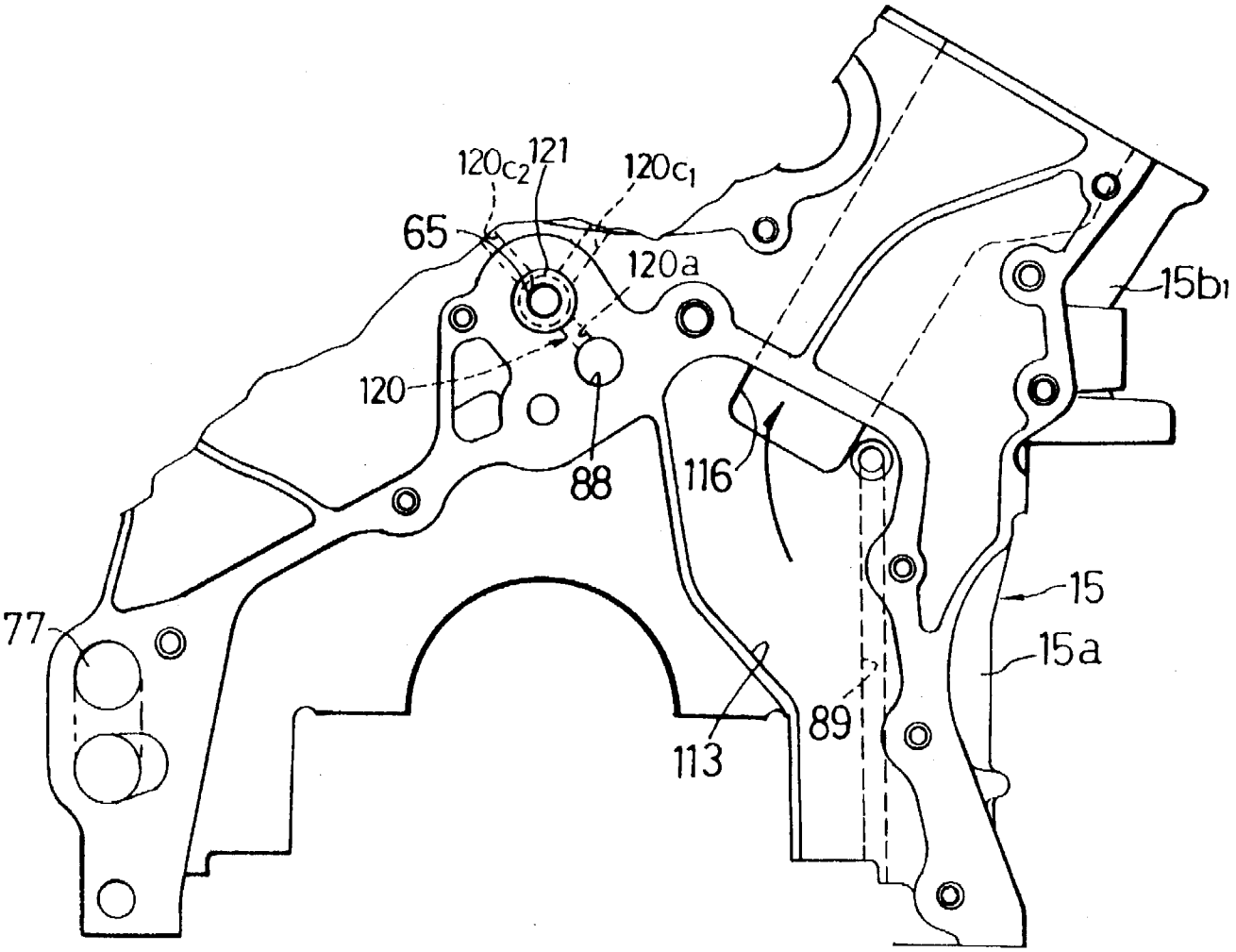
FIG. 10 is a side view illustrating a coupled surface of a cylinder block to the pump body.

The other end of the oil passage 79 communicates with a recess 82 (see FIG. 4) which is provided in a surface of the pump body 28 on the side of the cylinder block 15. When the pump body 28 is coupled to the cylinder block 15, the recess 82 communicates with the main gallery 65 provided in the cylinder block 15, as shown in FIG. 10. Thus, the oil passage 79 communicates with the main gallery 65.

A waste space D (see FIGS. 1 and 3) is produced outside the idle pulley 39 by engagement of the idle pulley 39 with the timing belt 38. The waste space D is located between the first driving pulley 36 and the follower pulley $37_1$ of the wrapping connector driving system T. The hydraulic pressure control valve V is disposed in the pump body 28 to lie in the waste space D outside the cover 45 which covers the wrapping connector driving system T, i.e., the valve is disposed outside the ridge 46.

The pump body 28 includes an inlet oil passage 83 connected at its inner end to the oil passage 79 and closed by a cap 85, and an outlet passage 84 closed at its outer end by a cap 86 (see FIG. 4). The inlet and outlet passages 83 and 84 are provided in the pump body 28 in parallel to each other. An inner end of the outlet passage 84 communicates with a circular recess 87 which is provided in the surface of the pump body 28 on the side of the cylinder block 15 at a location adjacent the recess 82. Moreover, when the pump body 28 is coupled to the cylinder block 15, the circular recess 87 communicates with an oil passage 88 provided in the cylinder block 15, as shown in FIG. 10. The oil passage 88 is defined in the cylinder block 15 in the form of a bottomed hole opening toward the pump body 28 to have an axis parallel to the crankshaft 28.

A valve mounting seat 91 (see FIG. 4) is provided on the outer surface of the pump body 28 to extend a long distance in a direction substantially perpendicular to a lengthwise direction of the inlet and outlet oil passages 83 and 84. The following openings open into the valve mounting seat 91: 1) an inlet opening 92 leading to the inlet oil passage 83; 2) an outlet opening 93 leading to the outlet oil passage 84; and 3) a discharge opening 94. When the pump body 28 is coupled to the cylinder block 15, the discharge opening 94 communicates with a discharge passage 89 provided in the cylinder block 15. The discharge passage 89 extends downwardly within the cylinder block 15 and has a lower end which opens into the oil pan 17.

Referring particularly to FIG. 6, the hydraulic pressure control valve V includes a valve spool 99 which is slidably received in a housing 95 for movement between a lower hydraulic pressure position (an upper position) in which lower-pressure oil is supplied to the oil passages $\mathbf{60}_1$ and $\mathbf{60}_2$ and a higher hydraulic pressure position (a lower position) in which higher-pressure oil is supplied to the oil passages $\mathbf{60}_1$ and $\mathbf{60}_2$. The housing 95 is coupled to the valve mounting seat 91 and has an outlet port 97 leading to the outlet opening 93, and a release port 98 leading to the discharge opening 94.

A cylinder bore 101 is provided in the housing 95 and is closed at its upper end by a cap 100. The valve spool 99 is slidably received in the cylinder bore 101 to define a pilot chamber 102 between the valve spool 99 and the cap 100. Moreover, a spring 104 for biasing the valve spool 99 upwardly is accommodated in a spring chamber 103 defined between a lower portion of the housing 95 and the valve spool 99. The valve spool 99 is biased upwardly, i.e., toward the lower hydraulic pressure position by the spring 104, and when a higher hydraulic pressure is applied to the pilot chamber 102, the valve spool 99 is moved toward the higher hydraulic pressure position by a hydraulic pressure force in the pilot chamber 102. An annular recess 105 is provided in the valve spool 99 and capable of putting the inlet and outlet ports 96 and 97 into communication with each other. When the valve spool 99 has been moved upwardly, as shown in FIG. 6, the valve spool 99 is in a state in which it cuts off communication between the inlet and outlet ports 96 and 97.

In a condition in which the housing 95 has been coupled to the pump body 28, an oil filter 106 is clamped between the inlet port 96 and the inlet opening 92. A constricting bore 107 is provided in the housing 95 to permit the communication between the inlet and outlet ports 96 and 97. Thus, even in a condition in which the valve spool 99 is in the lower pressure position, the inlet and outlet ports 96 and 97 are in communication with each other through the constricting bore 107, and the hydraulic pressure constricted in the constricting bore 107 is delivered through the outlet port 97.

A bypass port 108 is provided in the housing 95 and adapted to lead to the outlet port 97 through the annular recess 105, only when the valve spool 99 is in the lower hydraulic pressure position. The bypass port 108 communicates with the release port 98. A leak jet 109 is provided in the housing 95 for putting the pilot chamber 102 into communication with the release port 98.

A connecting bore 110 is provided in the cap 100 to lead to the pilot chamber 102. A solenoid valve 111 is mounted on the housing 95 and intervenes between a) an oil passage 112, provided in the housing 95, which leads to the inlet port 96 and b) the connecting bore 110.

Thus, by energizing and opening the solenoid valve 111, a hydraulic pressure can be applied to the pilot chamber 102 to move the valve spool 99 to the higher hydraulic pressure position. By deenerizing and closing the solenoid valve 111, the hydraulic pressure in the pilot chamber 102 can be reduced to move the valve spool 99 to the lower hydraulic pressure position.

Figure 11:
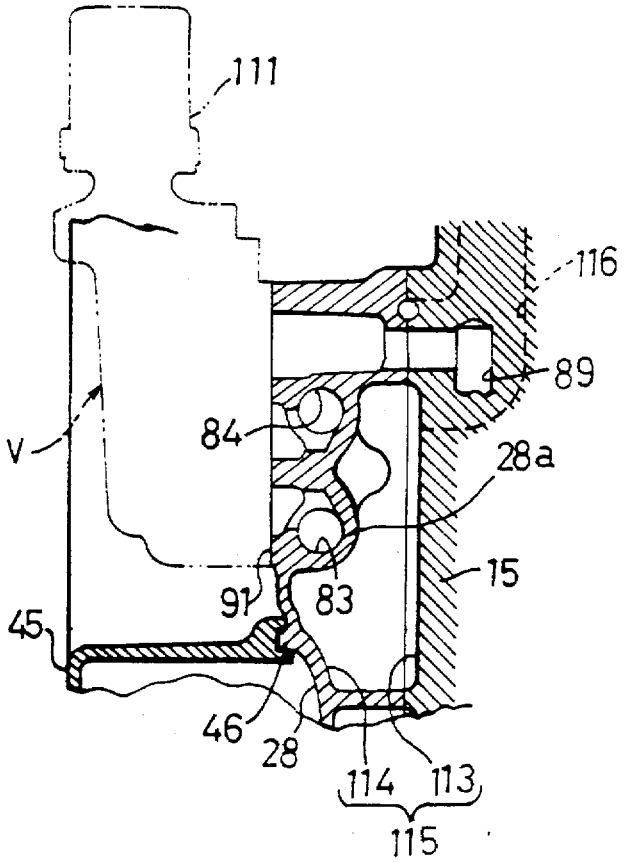
FIG. 11 is a sectional view taken along a line 11—11 in FIG. 3.
Figure 12:
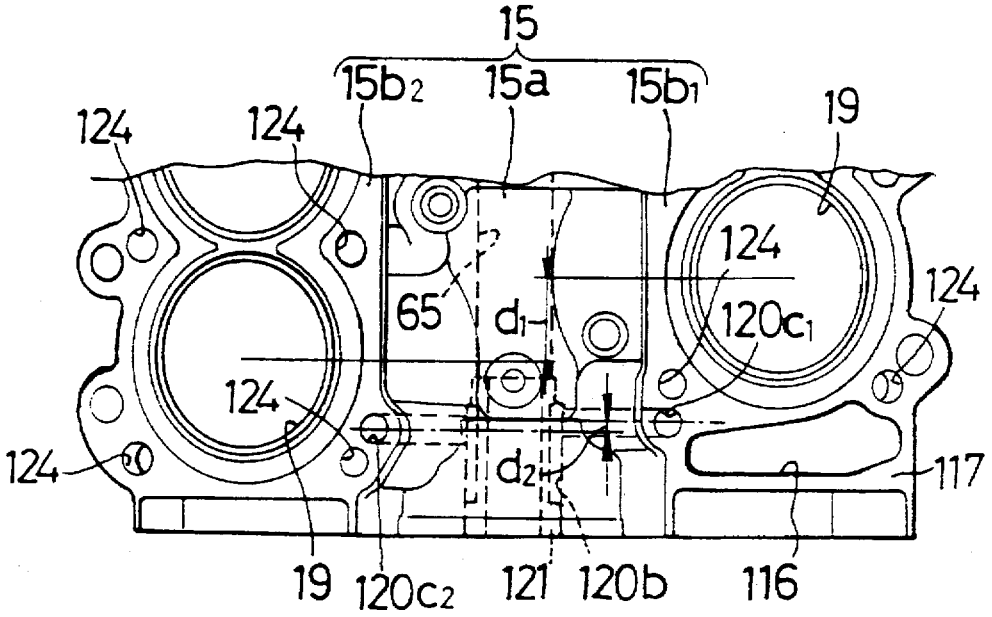
FIG. 12 is a plan view of the cylinder block.

Referring also to FIGS. 11 and 12, a recess 114 is provided in the surface of the pump body 28 on the side of the cylinder block 15 to define a lower blow-by gas passage 115 by cooperation with a recess 113 which is provided on the outer surface of the sidewall of the cylinder block 15. The lower blow-by gas passage 115 opens at its lower end into a crank chamber defined in the cylinder block 15.

In the cylinder block 15, the cylinder bores 19 provided in one of the cylinder barrels $\mathbf{15}b_1$ and the cylinder bores 19 provided in the other cylinder barrel $\mathbf{15}b_2$ are disposed so as to be offset from each other by an offset amount $d_1$, as shown in FIG. 12. A thick portion 117 is formed at one end of the one cylinder barrel $\mathbf{15}b_1$ as viewed in the axial direction of the crankshaft 23, i.e., an end of the side wall to which the pump body 28 is coupled, due to the fact that the cylinder bores 19 are offset by the offset amount $d_1$. An upper blow-by gas passage 116 is provided in the thick portion 117 to extend vertically, and has a lower end communicating with an upper end of the lower blow-by gas passage 115.

Moreover, a portion of the pump body 28, in which the inlet and outlet oil passages 83 and 84 are defined, is formed as a protrusion 28*a* projecting into an upper portion of the lower blow-by gas passage 115.

A blow-by gas flows upwardly via the lower blow-by gas passage 115 into the upper blow-by gas passage 116. In this case, the separation of oil entrained on the blow-by gas is promoted by collision of the blow-by gas against the protrusion 28*a* in the middle of such a flow. In addition, the entire engine body E can be formed in a compact manner by effectively utilizing the thick portion 117 of the cylinder block 15.

The outlet oil passage 84 is provided in the pump body 28 and is connected to the outlet port 97 in the hydraulic pressure control valve V. The outlet oil passage 84 communicates with the oil passage 88 provided in the cylinder block 15. A control hydraulic pressure passage 120 is provided in the cylinder block 15 and connected to the oil passage 88 to communicate with the oil passage $\mathbf{60}_1$ and $\mathbf{60}_2$ provided within the rocker shafts $\mathbf{54}_1$ and $\mathbf{54}_2$ in the cylinder heads $\mathbf{16}_1$ and $\mathbf{16}_2$.

The main gallery 65 as a first oil passage is provided in the cylinder block 15, in parallel to the crankshaft 23, at a central portion between left and right banks in the engine body E. The control hydraulic pressure passage 120 as a second oil passage is provided in the cylinder block 15 to connect the oil passage 88, located below the main gallery 65, with the oil passages $\mathbf{60}_1$ and $\mathbf{60}_2$ within the rocker shafts $\mathbf{54}_1$ and $\mathbf{54}_2$ which are disposed in the cylinder barrels $\mathbf{15}b_1$ and $\mathbf{15}b_2$ and which are located in the upper portion of the cylinder block 15. Therefore, the main gallery 65 and the control hydraulic pressure passage 120 are disposed in such a manner that they intersect each other when viewed in projection onto a plane parallel to the axis of the main gallery 65 (i.e. perpendicular). However, it is required that the hydraulic pressure of the oil flowing through the main gallery 65 and the hydraulic pressure of the oil flowing through the control hydraulic pressure passage 120 are different from each other, and that the main gallery 65 and the control hydraulic pressure passage 120 are defined so that they are isolated from each other. If the main gallery 65 and the control hydraulic pressure passage 120 are disposed so that the intersections when viewed in the projection are spaced apart from each other, it is necessary to establish a correspondingly large space in the cylinder block 15, leading to an increase in size of the cylinder block 15.

Therefore, according to the present invention, the control hydraulic pressure passage 120 is defined in a structure in which it is unnecessary to insure a large space in the cylinder lock 15.

Figure 13:
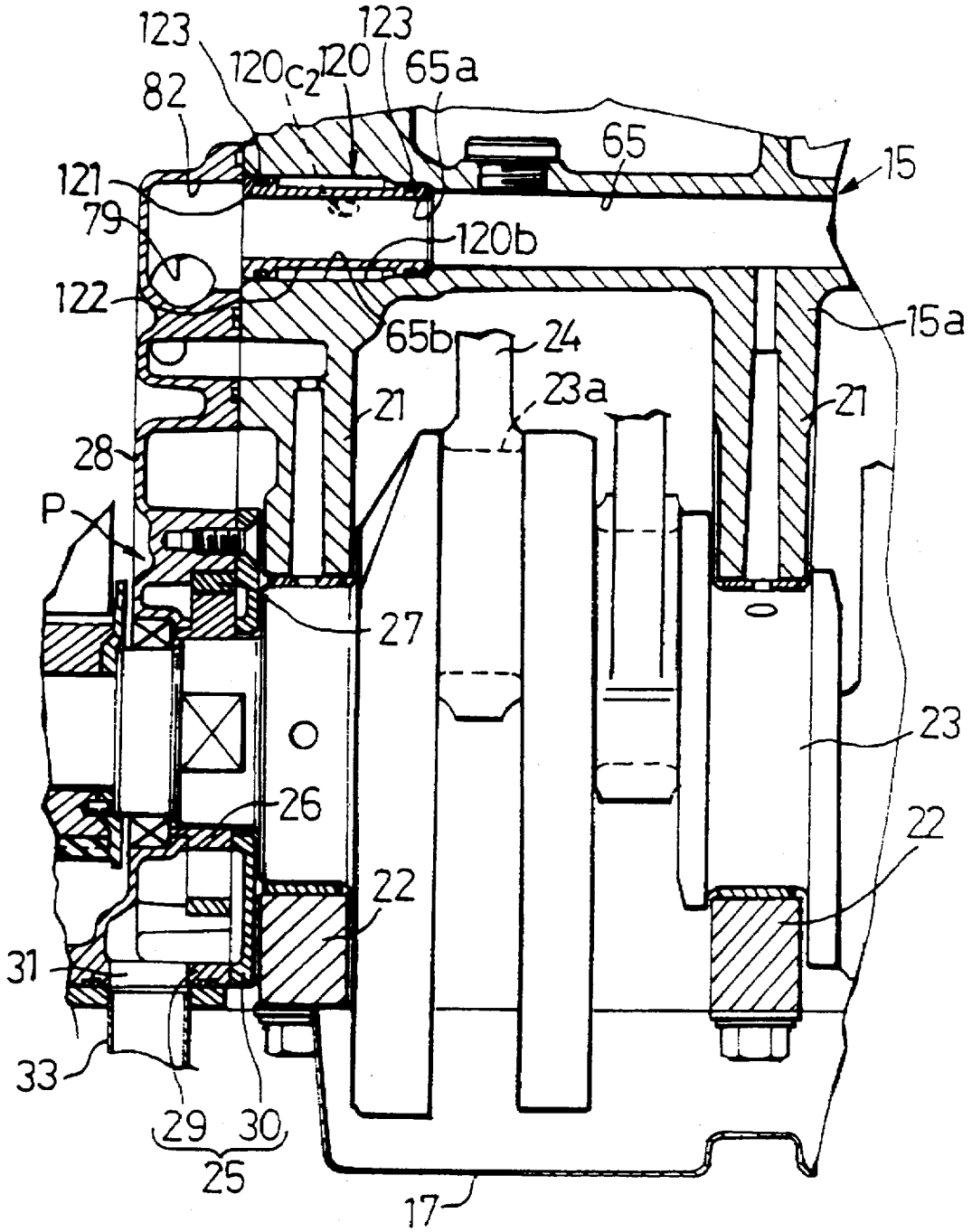
FIG. 13 is a sectional view taken along a line 13—13 in FIG. 3.
Figure 14:
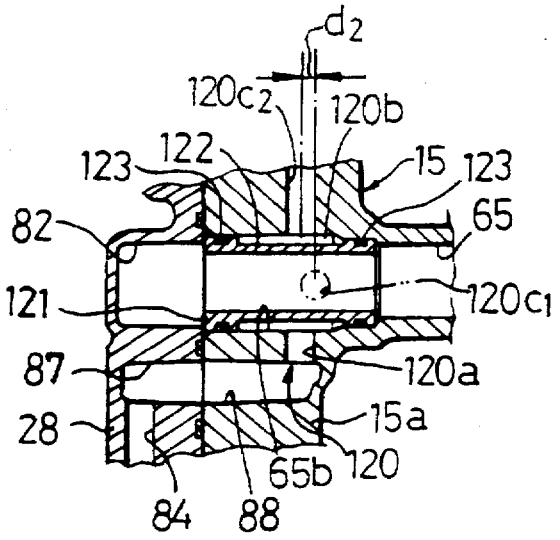
FIG. 14 is a sectional view taken along a line 14—14 in FIG. 3.

Referring to FIGS. 13 and 14, a large-diameter bore portion **65*b* is provided at an opened end of the oil gallery 65 adjacent the pump body 28. A cylindrical partition member 121 is fitted into the large-diameter bore portion 65*b* in a manner that it is clamped between the step portion 65*a* and the pump body 28. An annular recess 122 is provided in an outer peripheral surface of the partition member 121 at its axially intermediate portion, and annular seal members 123, 123 are mounted on an outer surface of the partition member 121 at its opposite ends. In a condition in which the partition member 121 has been fitted into the large-diameter bore portion 65*b* of the main gallery 65, an annular intermediate chamber 120*b* is defined between the outer surface of the partition member 121 and an inner surface of the large-diameter bore portion 65*b* of the main gallery 65. The intermediate chamber 120*b* is sealed at its opposite ends by the seal members 123, 123. The intermediate chamber 120*b* is isolated from the main gallery 65 by the partition member 121**.

The control hydraulic pressure passage 120 includes a) an upstream passage **120*a* interconnecting an inner end of the oil passage 88 and the intermediate chamber 120*b*; b) the intermediate chamber 120*b*; c) a first downstream passage portion $\mathbf{120}c_1$ interconnecting the upper surface of the cylinder barrel $\mathbf{15}b_1$ and the intermediate chamber 120*b*; and d) a second downstream passage portion $\mathbf{120}c_2$ interconnecting the upper surface of the cylinder barrel $\mathbf{15}b_2$ and the intermediate chamber 120*b*. The upstream passage 120*a*** and the second downstream passage portion $\mathbf{120}c_2$ are disposed coaxially and on one straight line.

In the V-shaped engine body E, the cylinder bores 19 on the two banks are disposed offset from each other by the offset amount $d_1$, as shown in FIG. 12, and in general, the upper blow-by gas passage 116 or an oil return passage is disposed in the thick portion 117 formed due to such offsetting. If an attempt is made to align the positions at which the first and second downstream passage portions $\mathbf{120}c_1$ and $\mathbf{120}c_2$ are disposed, with each other in an axial direction of the crankshaft 23, the cylinder block 15 must be large-sized to insure a sufficient flow area of the upper blow-by gas passage 116 or the oil return passage and moreover to avoid interference of the first downstream passage portion $\mathbf{120}c_1$ with the upper blow-by gas passage 116 or the oil return passage. In addition, to avoid an increase in size of the cylinder block 15 and to avoid interference of the first downstream passage portion $\mathbf{120}c_1$ with the upper blow-by gas passage 116 or the oil return passage, there is a possibility that the flow area of the upper blow-by gas passage 116 or the oil return passage cannot be insured. In order to avoid such a problem, the positions of openings of the first and second downstream passage portions $\mathbf{120}c_1$ and $\mathbf{120}c_2$ into the cylinder barrels $\mathbf{15}b_1$ and $\mathbf{15}b_2$ may be offset by an offset amount $d_2$ in the same direction as the offset direction of the cylinder bores 19 along the axis of the crankshaft 23. However, in a structure in which the first and second downstream passage portions $\mathbf{120}c_1$ and $\mathbf{120}c_2$ diverge directly from the upstream passage **120*a*, it is necessary to bend an intermediate portion of at least one of the first and second downstream passage portions $\mathbf{120}c_1$ and $\mathbf{120}c_2$. To provide such a bent-type structure, the drilling in the cylinder block 15 is complicated. However, the first and second downstream passage portions $\mathbf{120}c_1$ and $\mathbf{120}c_2$ communicate with the upstream passage portion 120*a* through the intermediate chamber 120*b* extending in the axial direction of the crankshaft 23, and the positions of openings of the upstream passage portion 120*a* through the intermediate chamber 120*b* into the intermediate chamber 120*b* may be offset by the offset amount $d_2$ along the axis of the crankshaft 23**. Therefore, it is unnecessary to subject the cylinder block to the complicated drilling.

Bores designated by reference character 124 in FIG. 12 are head bolt bores used for mounting the cylinder head $\mathbf{16}_2$ and $\mathbf{16}_2$ to the cylinder block 15.

The operation of the first embodiment will be described below. The annular intermediate chamber **120*b* is defined between the outer surface of the partition member 121 and the inner surface of the main gallery 65 by fitting the cylindrical partition wall 121, with the annular seal members 123, 123 mounted on the outer surface at its opposite ends, into the in gallery 65 provided in the cylinder block 15. The control hydraulic pressure passage 120 is provided in the cylinder block 15 in the arrangement where the first and second downstream passage portions $\mathbf{120}c_1$ and $\mathbf{120}c_2$ communicate with each other through the intermediate chamber 120*b*. The control hydraulic pressure passage 120 is defined around the main gallery 65 to intersect the main gallery 65 at an intersection provided by the intermediate chamber 120*b* which is isolated from the main gallery 65. Therefore, it is unnecessary to space the intersections of the main gallery 65 and the control hydraulic pressure passage 120 apart from each other, whereby a space for such spacing-apart is not required. This can contribute to a reduction in size of the cylinder block 15** and thus a reduction in size of the engine body E.

When the control hydraulic pressure passage 120 is disposed so as to diverge into the two banks in the V-shaped engine body E, the positions, at which the first and second downstream passage portions $\mathbf{120}c_1$ and $\mathbf{120}c_2$ disposed in the cylinder barrels $\mathbf{15}b_1$ and $\mathbf{15}b_2$ communicate with the intermediate chamber **120*b*, are offset in the axial direction of the crankshaft 23, thereby facilitating the drilling conducted in the cylinder block 15 and moreover, it is possible to reduce the size of the cylinder block 15, as well as to insure a sufficient flow area of the upper blow-by gas passage 116** or the oil return passage.

Moreover, by the fact that the upstream passage portion **120*a* and the second downstream passage portion $\mathbf{120}c_2$ in the control hydraulic pressure passage 120 are disposed coaxially and in one straight line in the engine body E, it is extremely easy to drill the upstream passage portion 120*a*** and the second downstream passage portion $\mathbf{120}c_2$.

Figure 15:
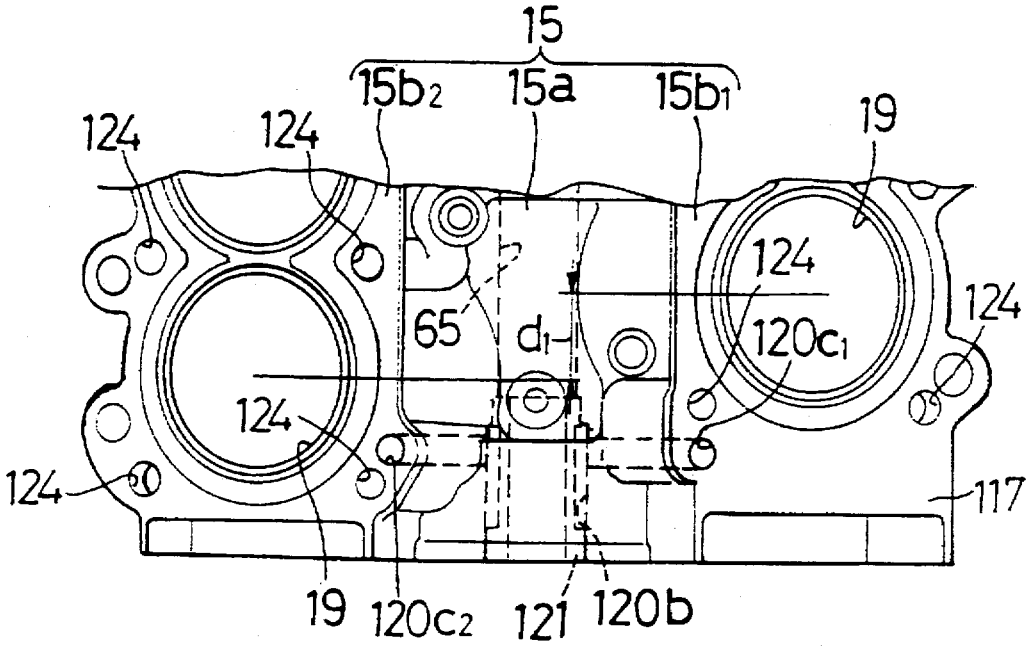
FIG. 15 is a plan view similar to FIG. 12, but illustrating a second embodiment of the present invention.

FIG. 15 shows a second embodiment of the present invention, wherein portions or components corresponding to those in the first embodiment are designated by like reference characters.

In the V-shaped engine body E, the thick portion 117 is formed in the cylinder block 15 in one of the banks, as a result of the cylinder bores 19 in the two banks being disposed offset by the offset amount $d_1$. However, when the upper blow-by gas passage 116 (see FIG. 12) or the oil return passage is not located in the thick portion 117, the first and second downstream passage portions 120$c_1$ and 120$c_2$ of the control hydraulic pressure passage 120 may be disposed in the cylinder barrels 15$b_1$ and 15$b_2$ in the engine body E at substantially the same positions in the axial direction of the crankshaft 23.

With the second embodiment, the ends of the downstream passage portions 120$c_1$ and 120$c_2$ which open into the intermediate chamber 120*b* can be located at substantially the same position in the axial direction of the partition member 121, thereby shortening the axial length of the partition member 121. This can contributes to a reduction in size of the engine body E.

Figure 16:
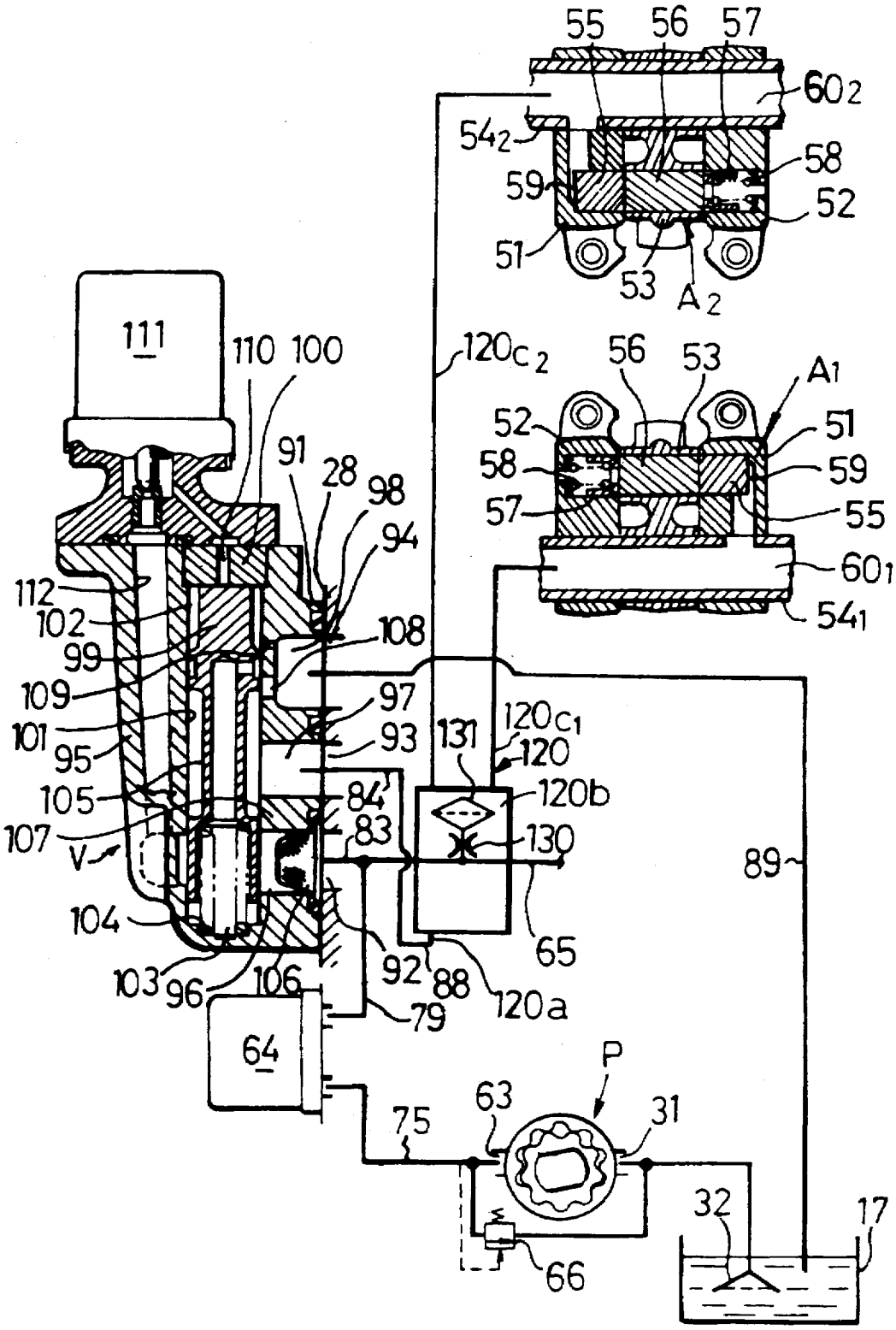
FIG. 16 is a view of a hydraulic circuit similar to FIG. 6, but illustrating a third embodiment of the present invention.
Figure 17:
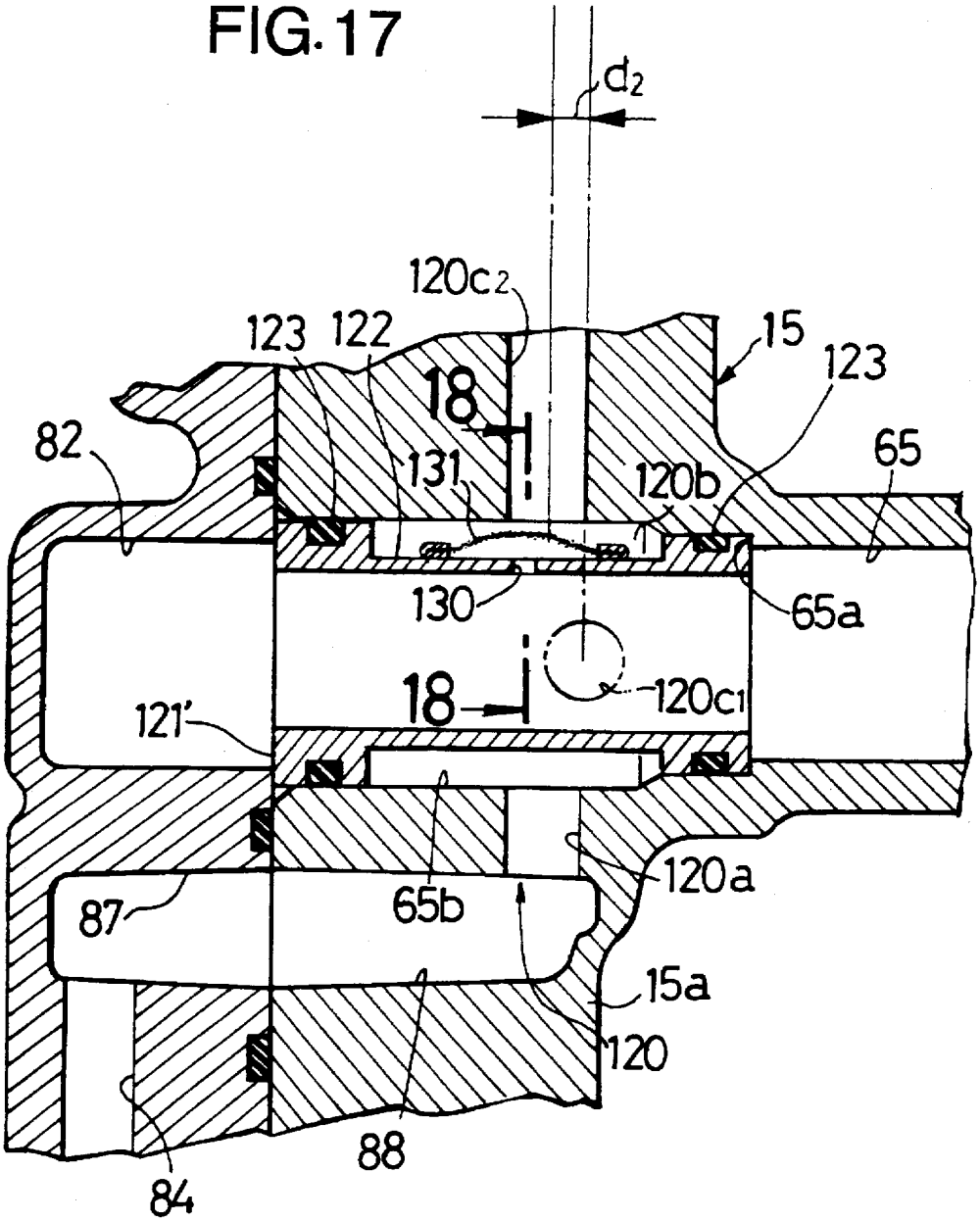
FIG. 17 is a sectional view similar to FIG. 14, but illustrating the third embodiment of the present invention.
Figure 18:
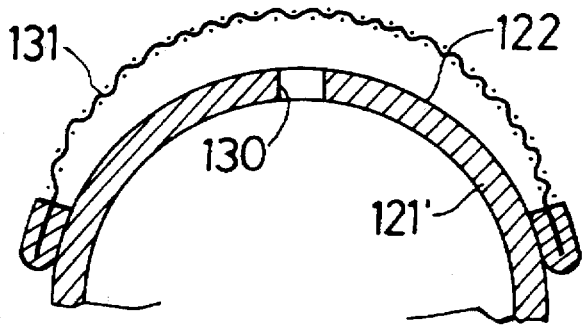
FIG. 18 is an enlarged sectional view taken along a line 18—18 in FIG. 17.

FIGS. 16 to 18 shows a third embodiment of the present invention, wherein portions or components corresponding to those in the above-described embodiments are designated by like reference characters.

In the above-described embodiments, the constricting bore 107 interconnecting the inlet and outlet ports 96 and 97 in the hydraulic pressure control valve V is provided in the housing 95. In contrast, in the third embodiment, no constricting bore is provided in a hydraulic pressure control valve V, as shown in FIG. 16, and instead, the main gallery 65 communicates with the intermediate chamber 120*b* of the control hydraulic pressure chamber 120 through a constricting bore 130 and a filter 131 without going via the hydraulic pressure control valve V.

As shown in FIGS. 17 and 18, a cylindrical partition member 121' is fitted into the large-diameter bore 65*b* provided at the opened end of the main gallery 65 on the side of the pump body 28, so that it is clamped between the stepped portion 65*a* and the pump body 28. An annular intermediate chamber 120*b* is defined between an outer surface of the partition member 121' and the inner surface of the large-diameter bore 65*b* and sealed at its opposite ends by seal members 123, 123. Moreover, the constricting bore 130 is provided in the partition member 121', and the filter 131 is secured to an outer periphery of the partition member 121, by brazing or by another technique to cover an outer end of the constricting bore 130. Thus, the main gallery 65 communicates with the intermediate chamber 120*b* of the control hydraulic pressure chamber 120 through the constricting bore 130 and the filter 131.

With the third embodiment, when the valve spool 99 of the hydraulic pressure control valve V is at its lower hydraulic pressure position, the inlet and outlet ports 96 and 97 are out of communication with each other, so that oil discharged from the oil pump P passed through the filter/cooler unit 64 is fed from the main gallery 65 via the constricting bore 130 and the filter 131 into the intermediate chamber of the control hydraulic pressure chamber 120 without passing through the hydraulic pressure control valve V. Therefore, the oil which is reduced in pressure in the constricting bore 130 and purified in the filter 131 is fed from the intermediate chamber 120*b* via the first and second downstream passage portions 120$c_1$ and 120$c_2$ to the hydraulic actuators $A_1$ and $A_2$. In other words, when the valve spool 99 of the hydraulic pressure control valve V is at its lower hydraulic pressure position, the oil from the filter/cooler unit 64 cannot be passed through the inlet and outlet ports 96 and 97, the outlet oil passage 84, the oil passage 88 and the upstream passage portion 120*a* of the control hydraulic pressure passage 120 and thus, it is possible to provide a reduction in pressure loss by a corresponding shortening in flowing path.

When the valve spool 99 of the hydraulic pressure control valve V has been moved to its higher hydraulic pressure position, the oil from the filter/cooler unit 64 is fed through the inlet oil passage 83, the inlet port 96, the outlet port 97, the outlet oil passage 84, the oil passage 88 and the upstream passage portion 120*a* of the control hydraulic pressure passage 120 to the intermediate chamber 120*b* without being reduced in pressure. During this time, the oil which is reduced in pressure from the main gallery 65 flows into the intermediate chamber 120*b*, because the inside of the main gallery 65 communicates with the intermediate chamber 120*b* through the constricting bore 130 in the partition member 121' and the filter 131. Thus, the hydraulic pressure in the intermediate chamber 120*b* is higher than that when the valve spool 99 of the hydraulic pressure control valve V is in its lower hydraulic pressure position. Therefore, the hydraulic actuators $A_1$ and $A_2$ are operated, thereby opening and closing the intake valves with an operational characteristic dependent upon high-speed operation.

Although the embodiments of the present invention have been described in detail, it will be understood that the present invention is not limited to the above-described embodiments, and various modifications in design may be made without departing from the spirit and scope of the invention defined in claims.

For example, the present invention is not limited to V-shaped engine, and is applicable as an oil passage structure in an engine, in which not only a combination of the main gallery 65 and the control hydraulic pressure passage 120, but also first oil passage and a second oil passage through which oil of a hydraulic pressure different from that in the first oil passage flows are provided in an engine body E in an arrangement where the oil passages intersect each other as viewed projection onto a plane parallel to an axis of the first oil passage.

What is claimed is:

1. An oil passage structure in an engine, comprising:

a first oil passage having oil of a first hydraulic pressure;

a second oil passage having oil of a second hydraulic pressure which is different from said first hydraulic pressure, said first and second oil passages being provided in an engine body in an arrangement where they intersect each other when viewed in projection onto a plane parallel to an axis of the first oil passage;

a cylindrical partition member fitted into said first oil passage and provided on its outer surface at opposite ends thereof with annular seal members; and an annular intermediate chamber defined between the outer surface of said partition member and an inner surface of said first oil passage, and said annular intermediate chamber sealed at opposite ends by said seal members, said second oil passage being provided in the engine body such that upstream and downstream passage portions of the second oil passage communicate with each other through said intermediate chamber.

2. An oil passage structure in an engine according to claim 1, wherein said engine body is constructed into a V-shaped configuration having left and right banks whose cylinder bores are offset from each other in an axial direction of a crankshaft, wherein a portion having a predetermined thickness is formed in one of the banks at one end of the engine body in the axial direction of the crankshaft due to the offset of said cylinder bores, and wherein said first oil passage is provided in said engine body at a substantially central portion between both the banks and the first oil passage extends in parallel to the crankshaft, and said second oil passage comprises a) an upstream passage portion connected to said annular intermediate chamber, b) a first downstream passage portion provided in said engine body in one of said banks and connected to said intermediate chamber in such a manner as to not be located in a blow-by gas passage or an oil return passage which is provided in said portion, and c) a second downstream passage portion communicating with said intermediate chamber and provided in said engine body in the other bank, said first and second downstream passage portions being disposed in the engine body such as to be offset in the same direction as a direction of offset of said cylinder bores in said banks.

3. An oil passage structure in an engine according to claim 1, wherein said engine body is constructed into a V-shaped configuration having left and right banks, said first oil passage being provided in the engine body at a substantially central portion between both the banks and the first oil passage extends in parallel to a crankshaft, said second oil passage comprising a) an upstream passage portion connected to said intermediate chamber, b) a first downstream passage portion provided in said engine body in one of the banks and connected to said intermediate chamber, and c) a second downstream passage portion provided in said engine body in the other bank to communicate with said intermediate chamber, said first and second downstream passage portions being disposed in said engine body substantially at the same positions along the axial direction of the crankshaft.

4. An oil passage structure in an engine according to claim 2, wherein said upstream passage portion and one of said first and second downstream passage portions of said second oil passage are defined axially and are defined on one straight line.

5. An oil passage structure in an engine according to claim 3, wherein said upstream passage portion and one of said first and second downstream passage portions of said second oil passage are defined axially and are defined in one straight line.

* * * * *